US007663653B2

(12) United States Patent
Tsujino et al.

(10) Patent No.: US 7,663,653 B2
(45) Date of Patent: Feb. 16, 2010

(54) OPTICAL HEAD AND IMAGE FORMING APPARATUS INCORPORATING THE SAME

(75) Inventors: Kiyoshi Tsujino, Nagano-ken (JP); Ken Ikuma, Nagano-ken (JP); Nozomu Inoue, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 399 days.

(21) Appl. No.: 11/361,707

(22) Filed: Feb. 24, 2006

(65) Prior Publication Data

US 2006/0192834 A1 Aug. 31, 2006

(30) Foreign Application Priority Data

Feb. 24, 2005 (JP) ..... 2005-048233
Feb. 24, 2005 (JP) ..... 2005-048234
Feb. 24, 2005 (JP) ..... 2005-048235

(51) Int. Cl.
*G03G 15/01* (2006.01)
*G03G 13/04* (2006.01)

(52) U.S. Cl. ..... 347/119; 347/134

(58) Field of Classification Search ..... 347/119, 347/134, 36

See application file for complete search history.

(56) References Cited

U.S. PATENT DOCUMENTS 4,190,321 A * 2/1980 Dorer et al. ..... 359/581
6,429,451 B1 8/2002 Hung et al.
6,841,932 B2 1/2005 Aziz et al.
7,288,887 B2 7/2005 Aziz et al.
7,020,417 B2 3/2006 Nomura et al.
2004/0125196 A1 * 7/2004 Nomura et al. ..... 347/236
2005/0067945 A1 3/2005 Nishikawa et al.

FOREIGN PATENT DOCUMENTS

JP 08110671 A 4/1996
JP 11-138899 5/1999
JP 2000330058 A 11/2000
JP 2001332391 A 11/2001
JP 2003115389 A 4/2003
JP 2004039409 A 2/2004
JP 2004066611 A 3/2004
JP 2004258364 A 9/2004
JP 2005108736 A 4/2005
JP 2005522852 A 7/2005

* cited by examiner

*Primary Examiner*—Julian D Huffman
*Assistant Examiner*—Kar Yip
(74) *Attorney, Agent, or Firm*—Hogan & Hartson LLP

(57) ABSTRACT

An optical head is adapted to form an electrostatic latent image on an image carrier. A transparent substrate has a first face adapted to oppose the image carrier and a second face opposing the first face. An organic EL photo emitter is disposed so as to oppose the second face of the substrate. In the photo emitter, a light emitting layer is adapted to emit light irradiating the image carrier to form the electrostatic latent image. An electrode layer is laminated on the light emitting layer. A reflection reducer eliminates stray light generated when the light emitted from the light emitting layer is reflected by at least the electrode layer.

10 Claims, 14 Drawing Sheets

OPTICAL HEAD AND IMAGE FORMING APPARATUS INCORPORATING THE SAME

BACKGROUND OF THE INVENTION

The present invention relates to an optical head and an image forming apparatus incorporating the same.

Generally, a toner image forming device of an electrophotographic system comprises: a photosensitive body as an image carrier having a photosensitive layer on an outer peripheral surface thereof; a charger that uniformly charges the outer peripheral surface of the photosensitive body with electricity; an exposer for selectively exposing the outer peripheral surface, which is uniformly charged with electricity by the charger, to form an electrostatic latent image; and a developing device that applies toner serving as a developer to the electrostatic latent image formed by the exposer to make the latent image a visible image (toner image).

An image forming apparatus of a tandem type that forms a color image includes one of an intermediate transfer belt type, in which the toner image forming device described above are arranged in plural (for example, four) for an intermediate transfer belt, toner images formed on the photosensitive body by the single color toner image forming device are sequentially transferred to the intermediate transfer belt, and toner images of plural colors (for example, yellow, cyan, magenta, black) are overlapped together on the intermediate transfer belt to obtain a full color image on the intermediate transfer belt.

In the image forming apparatus of a tandem type, an optical head provided with a LED array or an organic EL element array is sometimes used as exposer. For example, Japanese Patent Publication No. 11-138899A discloses a light emitting diode array, in which light emitting diodes are mounted on a single chip.

An explanation will be given to an example of an optical head, in which an organic EL element is used for a light source and an image is formed on an image carrier by a rod lens array optical system. FIG. 6 shows such an optical head (image writer) 23 in a direction that the image carrier moves. A rod lens array 65 in which gradient index rod lenses 81 are arrayed is mounted to an opaque housing 60. An photo emitter array 61 is mounted so as to face a back face of the rod lens array 65 in the housing 60.

An opaque cover 66 shields the photo emitter array 61 in the housing from a back face side of the housing 60. The reference numeral 63 denotes a photo emitter (organic EL element), and 64 a cover glass. A plate spring 67 pushes the cover 66 against the back face of the housing 60 to close an interior of the housing 60 in a light-tight manner. The housing 60 covers a periphery of a glass substrate 62 but opens a side thereof facing an image carrier 20. Thus light outgoing from the photo emitter 63 is projected onto the image carrier 20 through the rod lens 81.

In the optical head shown in FIG. 6, a ghost light spot 93 is sometimes formed on the image carrier 20. The reason for this will be described below. When the photo emitter 63 is to be formed, an anode and a cathode are used. Since the cathode is formed from aluminum or the like, it serves as a mirror to reflect stray light in the grass substrate 62. Therefore, reflected light 95 transmits through the rod lens 81 whereby the ghost light spot 93 is formed on the image carrier 20.

FIG. 7 shows the image carrier 20 by seeing through the rod lens array 65. In this figure, the reference numerals 91, 92 denote exposure spots formed on the image carrier 20 by the photo emitter 63, CL denotes a center line of rod lens array 65, and 93, 94 denote ghost light spots. The ghost light spots include a large ghost light spot 93 formed to be concentric with the respective rod lenses 81, and a small ghost light spot 94 formed in the vicinity of the border between adjacent rod lenses 81. Such ghost light spots 93, 94 are formed on the image carrier 20 whereby there is caused a problem that image unevenness is formed to deteriorate the quality of image formation.

SUMMARY OF THE INVENTION

It is therefore an object of the invention to provide an optical head that eliminates formation of any ghost light spot on an image carrier due to stray light, and to provide an image forming apparatus incorporating such an optical head.

In order to achieve the above object, according to the invention, there is provided an optical head, adapted to form an electrostatic latent image on an image carrier, comprising:

a transparent substrate, having a first face adapted to oppose the image carrier and a second face opposing the first face;

an organic EL photo emitter, disposed so as to oppose the second face of the substrate and comprising:

a light emitting layer, adapted to emit light irradiating the image carrier to form the electrostatic latent image; and an electrode layer, laminated on the light emitting layer; and a reflection reducer, eliminating stray light generated when the light emitted from the light emitting layer is reflected by at least the electrode layer.

With this configuration, since any ghost light spot is not formed on the image carrier due to the stray light, it is possible to prevent generation of image unevenness. Accordingly, it is possible to improve the image formation quality.

The reflection reducer may include an anti-reflection film disposed on a surface of the electrode layer facing the light emitting layer.

The reflection reducer may include an anti-reflection coating provided on a surface of the electrode layer facing the light emitting layer.

The reflection reducer may include a surface of the electrode layer facing the light emitting layer a surface roughness of which is made greater than a surface roughness of any other part of the electrode layer.

The reflection reducer may include a light absorbing layer provided on the first face of the substrate.

The reflection reducer may include a light reflecting layer provided on the first face of the substrate, and a light absorbing layer provided on end faces of the substrate connecting the first face and the second face.

The reflection reducer may include a light reflecting layer provided on the first face of the substrate, and a light leading member provided on end faces of the substrate connecting the first face and the second face, and adapted to lead light reflected by the light reflecting layer toward an area on the image carrier to be irradiated with the light emitted from the photo emitter.

The reflection reducer may include an anti-reflection film disposed on the second face of the substrate.

The reflection reducer may include an anti-reflection coating provided on the second face of the substrate.

The reflection reducer may include the second face of the substrate a surface roughness of which is made greater than a surface roughness of the first face of the substrate.

The reflection reducer may include a cover member adapted to be disposed between the first face of the substrate and the image carrier. In this case, the cover member is formed with an aperture adapted to allow only the light emitted from the photo emitter to pass therethrough.

Here, the cover member may be shaped into a frustum, and the aperture is formed at an apex portion thereof.

The substrate may be comprised of glass.

According to the invention, there is also provided an image forming apparatus, comprising:

an image carrier; and an optical head, operable to form an electrostatic latent image on the image carrier, and comprising:

a transparent substrate, having a first face opposing the image carrier and a second face opposing the first face;

an organic EL photo emitter, disposed so as to oppose the second face of the substrate and comprising:

a light emitting layer, operable to emit light irradiating the image carrier to form the electrostatic latent image; and an electrode layer, laminated on the light emitting layer; and a reflection reducer, eliminating stray light generated when the light emitted from the light emitting layer is reflected by at least the electrode layer

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described with reference to the accompanying drawings.

Figure 2:
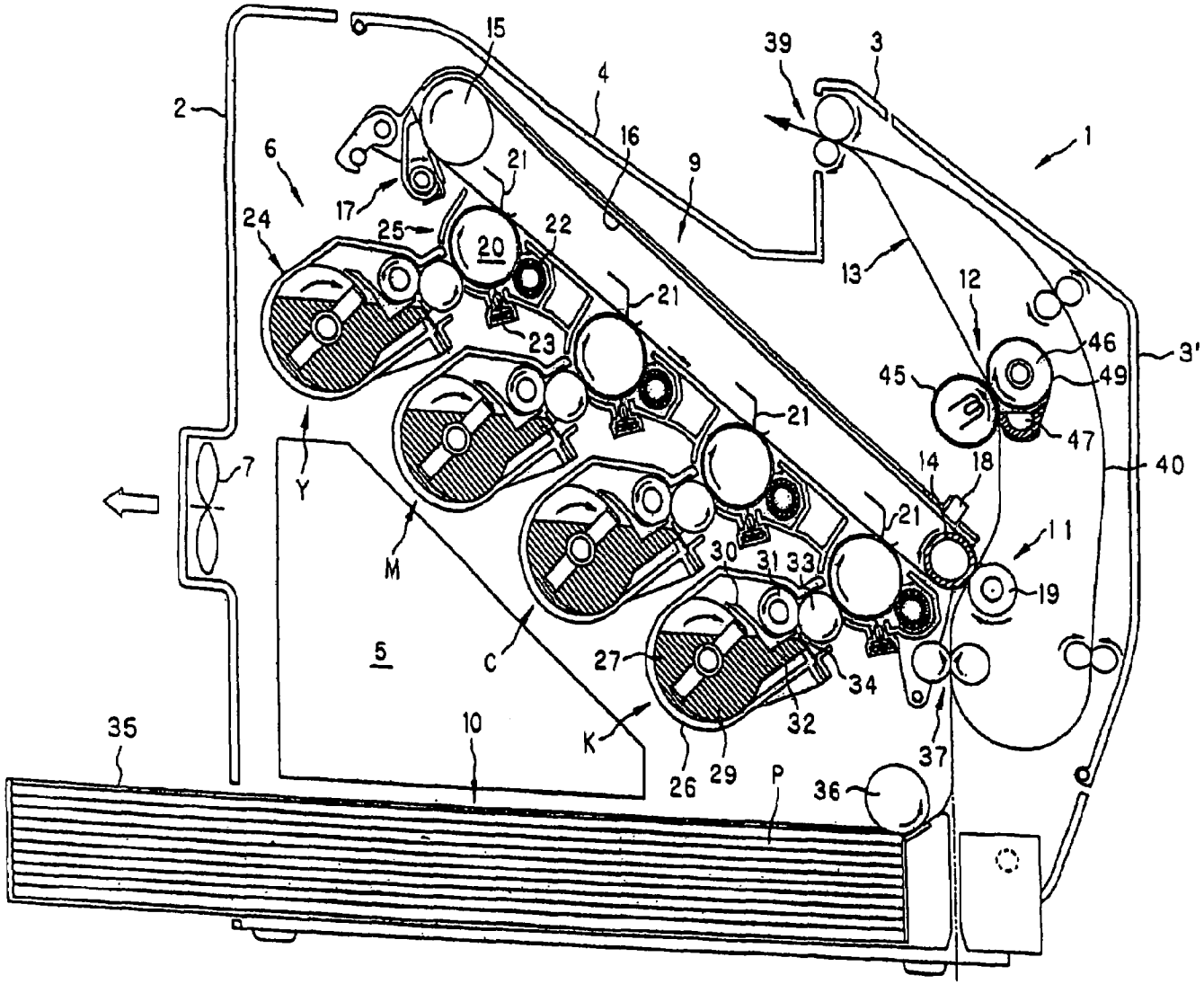
FIG. 2 is a section view of an image forming apparatus incorporating the optical head.

FIG. 2 shows an image forming apparatus 1 according to a first embodiment of the invention, which is a type that an intermediate transfer belt is incorporated.

The image forming apparatus 1 comprises: a housing body 2; a first door cover 3 mounted to a front face of the housing body 2; and a second door cover (serving as an ejection tray) 4 mounted to an upper face of the housing body 2. The first door cover 3 comprises a lid 3' which is able to opened and closed in association with the first door cover 3 or independently.

Arranged in the housing body 2 are an electrical equipment box 5 that houses therein a power circuit board and a control circuit board, an image forming unit 6, a ventilation fan 7, a transfer belt unit 9, and a sheet feeding unit 10. Arranged in the first door cover 3 are a secondary transfer unit 11, a fuser unit 12, and a sheet transporter 13. Expendable items in the image forming unit 6 and the sheet feeding unit 10 are made detachable from the body, in which case the items together with the transfer belt unit 9 can be removed for repair or exchange.

The transfer belt unit 9 comprises a drive roller 14 rotated by a drive source (not shown) arranged below the housing body 2, a follower roller 15 arranged obliquely upwardly of the drive roller 14, an intermediate transfer belt 16 stretched between the two rollers 14, 15 to be circulated in a direction indicated by an arrow as shown, and a cleaner 17 retractably coming in contact with a surface of the intermediate transfer belt 16. In this embodiment, the follower roller 15 and the intermediate transfer belt 16 are arranged in a direction, in which they are inclined relative to the drive roller 14 leftward in the figure.

A primary transfer member 21 composed of a leaf spring electrode in opposition to the image carriers 20 of respective image forming stations Y, M, C, K described later is caused by its elastic force to abut against a back face of the intermediate transfer belt 16, and transfer bias is applied to the primary transfer member 21. A test pattern sensor 18 is mounted on a support frame 9*a* of the transfer belt unit 9 to be close to the drive roller 14. The test pattern sensor 18 is one, which serves to position respective color toner images on the intermediate transfer belt 16 and to detect densities of respective color toner images to correct color misalignment and image densities of respective color images.

The image forming unit 6 comprises a plurality (four in the embodiment) of image forming stations Y (for yellow), M (for magenta), C (for cyan), K (for black), by which images of different colors are formed, and the image forming stations Y, M, C, K, respectively, comprise an image carrier 20 composed of a photosensitive drum, a charger 22, an optical head (image writer) 23, and a developing device 24, which are arranged around the image carrier 20. The charger 22, the image writer 23, and the developing device 24 are denoted by reference numerals only for the image forming station Y, and reference numerals are omitted for other image forming stations since the stations are the same in construction That order, in which the respective image forming stations Y, M, C, K are arranged, may be changed arbitrarily.

The image carriers 20 of the respective image forming stations Y, M, C, K are arranged to abut against a surface of the intermediate transfer belt 16, facing downward. Consequently, the respective image forming stations Y M, C, K are also arranged to be inclined leftward relative to the drive roller 14 in the figure. The image carriers 20 are rotated as indicated by an arrow in the figure in the circulating direction of the intermediate transfer belt 16. The intermediate transfer belt 16 is provided with the cleaner 17, which recovers toner left on the intermediate transfer belt after the transfer is performed.

The charger 22 is composed of a conductive brush roller connected to a high-voltage generating source, and an outer periphery of the brush abuts against and rotates at two to three times a circumferential speed of the image carrier 20 in a reverse direction to the rotating direction of the image carrier 20 to uniformly charge a surface of the image carrier 20 with electricity. Since the use of such charger 22 makes it possible to charge a surface of the image carrier with a very small electric current, contamination inside and outside the apparatus by a large amount of ozone as in the corona electrical charging system is eliminated. Also, since the brush roller abuts softly against the image carrier 20, toner left thereon after the transfer is performed is hard to adhere to the charging roller, so that it is possible to ensure a stable image quality and reliability in the apparatus.

The image writer 23 is an optical head in which organic EL elements are arrayed in an axial direction of the image carrier 20. Since an optical path length in such an optical head can be made shorter than a laser scanning optical system, the optical head can be made compact. Thus, it can be arranged close to the image carrier 20 and make the whole apparatus small in size. In this embodiment, the image carrier 20, the charger 22, and the image writer 23 in the respective image forming stations Y, M, C, K are integrated as one image carrier unit 25, and mounted on the support frame 9*a* together with the transfer belt unit 9 to be made capable of exchange, whereby positioning of the optical head relative to the image carrier 20 is preserved. It is configured such that the optical head is exchanged together with the image carrier unit 25.

Subsequently, the construction of the developing device 24 will be described with the image forming station K as a typical example. The developing device 24 comprises a toner container 26 that stores toner (shown by hatched portions in the figure), a toner storing part 27 formed in the toner container 26, a toner agitating member 29 arranged in the toner storing part 27, a partition member 30 compartmented and formed in an upper region of the toner storing part 27, a toner supplying roller 31 arranged above the partition member 30, a blade 32 provided on the partition member 30 to abut against the toner supplying roller 31, a developing roller 33 arranged so as to abut against the toner supplying roller 31 and the image carrier 20, and a control blade 34 that abuts against the developing roller 33. The image carrier 20 is rotated in the circulating direction of the intermediate transfer belt 16, and the developing roller 33 and the toner supplying roller 31 are rotated as indicated by an arrow in the figure in a reverse direction to the rotating direction of the image carrier 20.

The sheet feeding unit 10 comprises a sheet feeding part composed of a sheet feeding cassette 35, in which recording media P are stacked and held, and a pickup roller 36 that feeds the recording media P one by one from the sheet feeding cassette 35. Provided in the first door cover 3 are a resist roller pair 37 that regulates timing, in which the recording media P are fed to the secondary transfer part, the secondary transfer unit 11 brought into pressure contact with the drive roller 14 and the intermediate transfer belt 16, the fuser unit 12, the sheet transporter 13, a sheet ejecting roller pair 39, and a transporting path 40 for double-sided printing.

The fuser unit 12 comprises a heating roller 45 that houses therein a heating element such as a halogen heater, etc., a pressure roller 46 that pushes and biases the heating roller 45, a belt stretcher 47 arranged pivotably relative to the pressure roller 46, and a heat resisting belt 49 stretched between the heating roller 45 and the belt stretching member 47, and a color image secondarily transferred to a recording medium is fused therewith at a predetermined temperature in a nipping portion formed by the heating roller 45 and the heat resisting belt 49. In the embodiment, it becomes possible to arrange the fuser unit 12 in a space formed obliquely upwardly of the intermediate transfer belt 16, in other words, a space on an opposite side of the image forming unit 6 to the intermediate transfer belt 16, so that it is possible to decrease heat transfer to the image forming unit 6 and the intermediate transfer belt 16.

Figure 3:
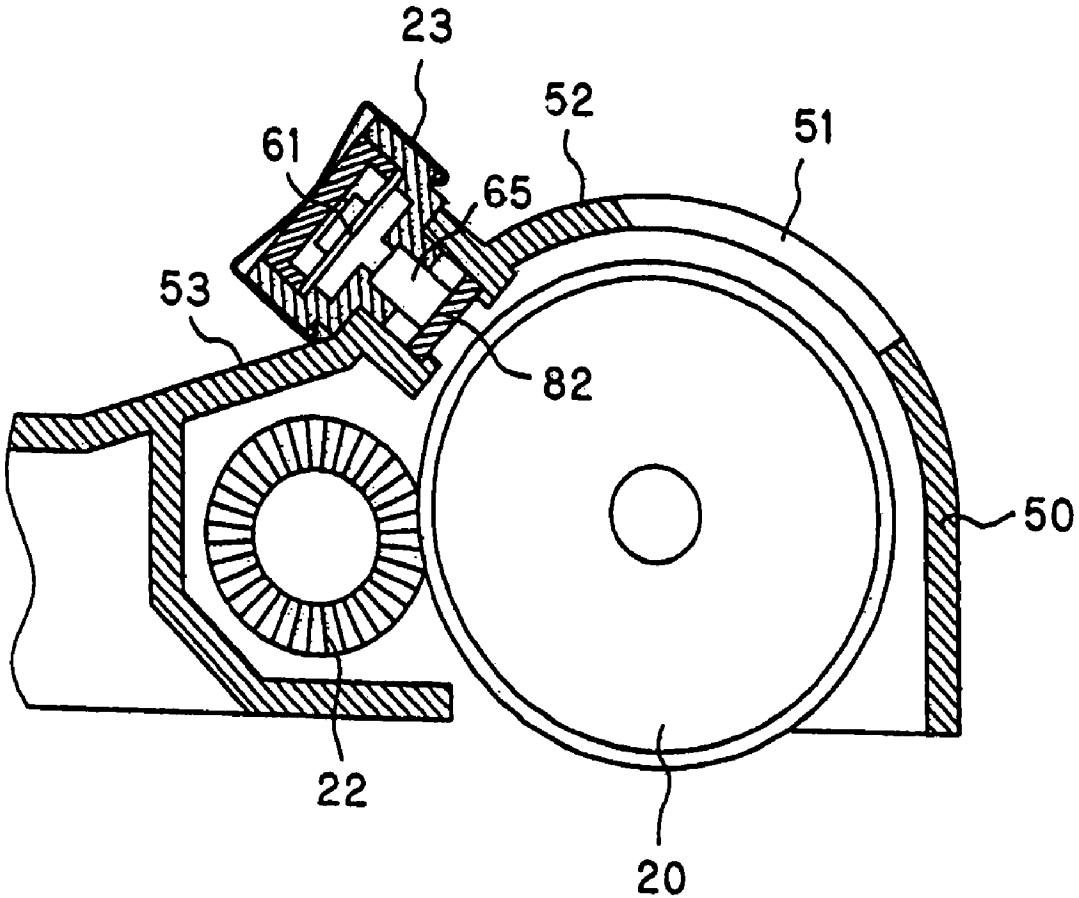
FIG. 3 is an enlarged section view of a part of an image forming unit in the image forming apparatus.

As shown in FIG. 3, the brush roller of the charger 22 is rotatably supported while being abutted against a predetermined position of the image carrier 20. The image writer 23 is disposed in a downstream side of the charger 22 relative to the rotating direction of the image carrier 20. An opening 51 is formed on a casing 50 in the downstream side of the image writer 23 to permit the developing roller 33 of the developing device 24 to abut against the image carrier 20 therethrough.

A shielding portion 52 of the casing 50 is left between each of the openings 51 and the image writer 23, and a shielding portion 53 of the casing 50 is left between the charger 22 and the image writer 23. The shielding portions 52, 53, in particular, the shielding portion 52 between the opening 51 and the image writer 23 prevents ultraviolet rays from reaching the photo emitter 63 in the image writer 23. The reference numeral 82 denotes a cleaning pad that performs wiping in the case where the rod lens array 65 becomes dirty.

Figure 4:
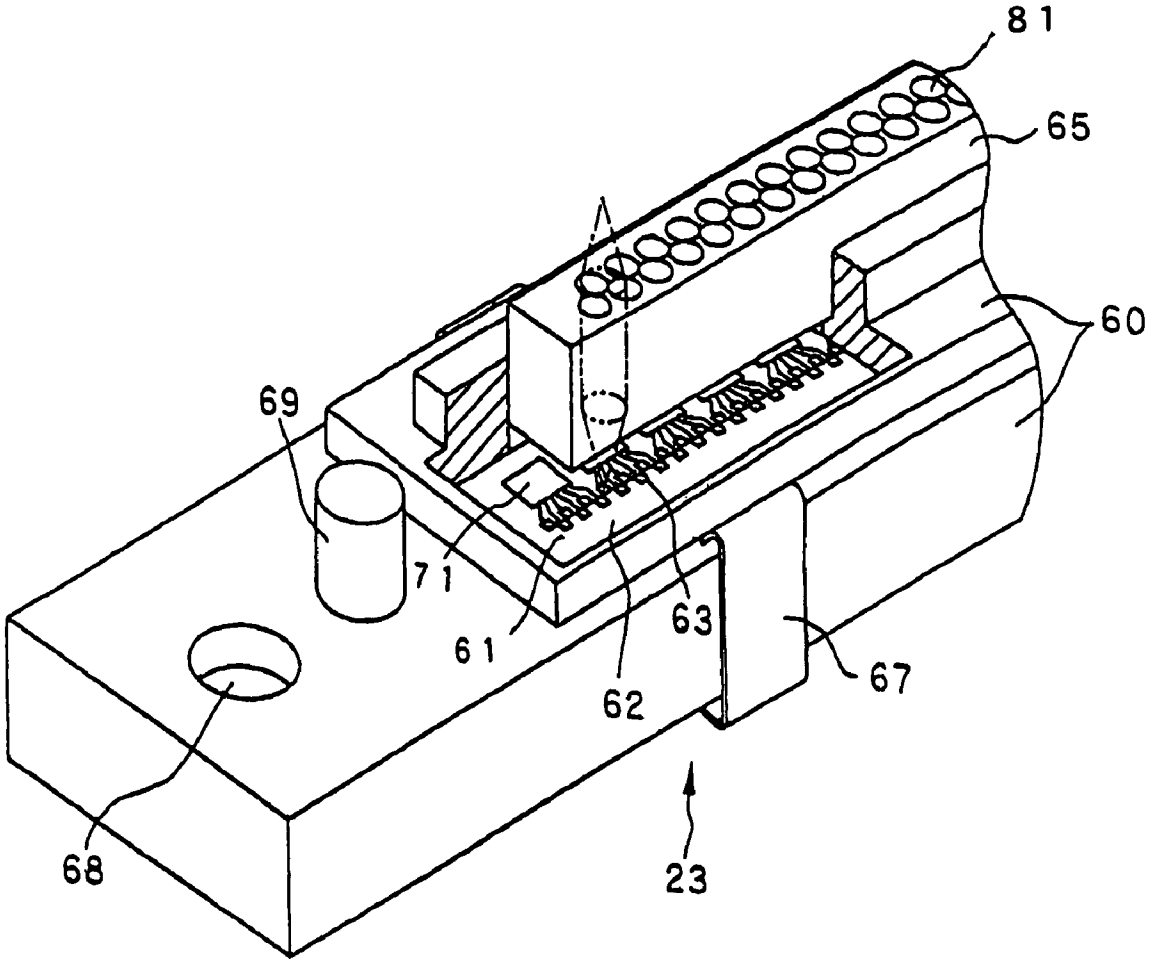
FIG. 4 is a perspective view of the optical head.

FIG. 4 shows an example of a mechanism that correctly positions the image writer 23 relative to the image carrier 20 (a photosensitive drum) mounted to the image carrier unit 25. The image carrier 20 shown in FIG. 2 is mounted by a shaft thereof rotatably to the casing 50 of the image carrier unit 25. Also, the photo emitter array 61 is held in the elongated housing 60.

The respective image writer 23 is fixed in a predetermined position by fitting positioning pins 69, which are provided on both ends of the elongated housing 60, in opposite positioning holes on the casing 50 and screwing and fixing lock screws into threaded holes of the casing 60 through screw insertion holes 68 provided on the both ends of the elongated housing 60.

Figure 5:
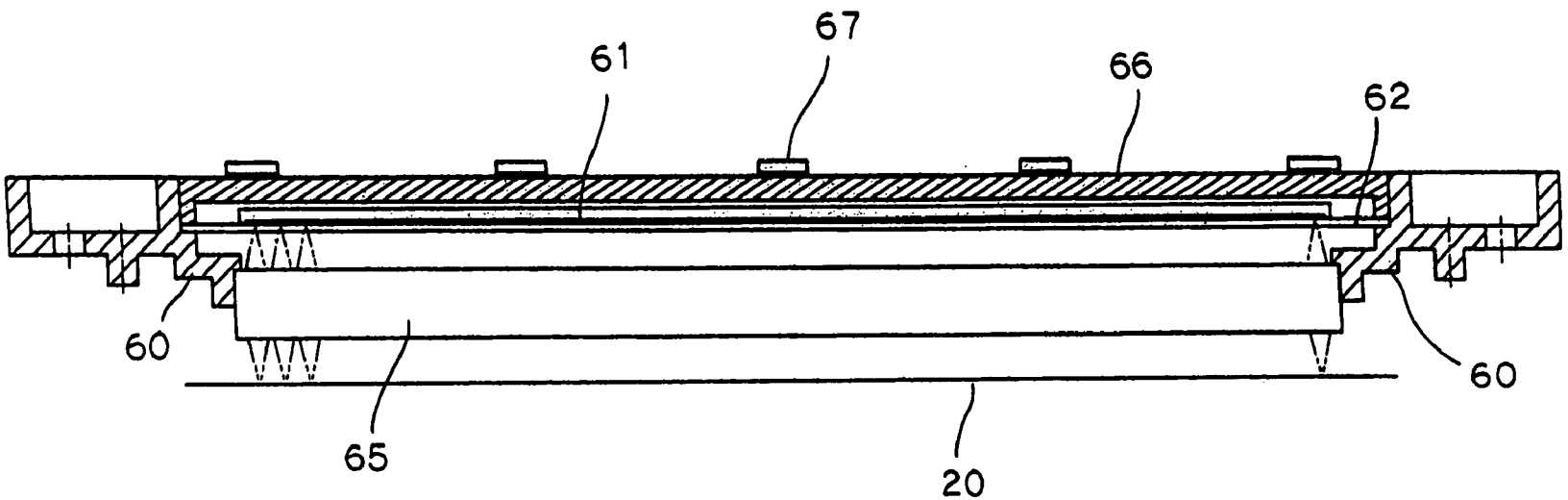
FIG. 5 is a section view of the optical head.
Figure 6:
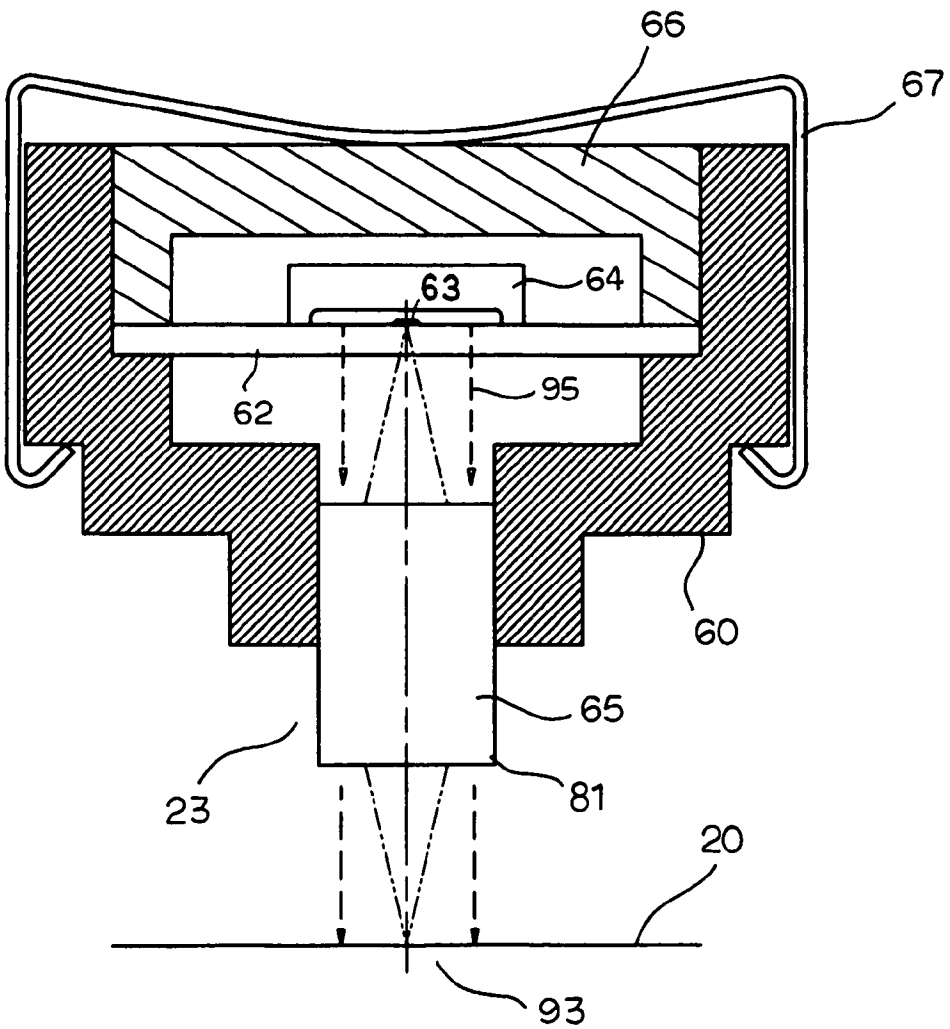
FIG. 6 is a section view of a related-art optical head.
Figure 7:
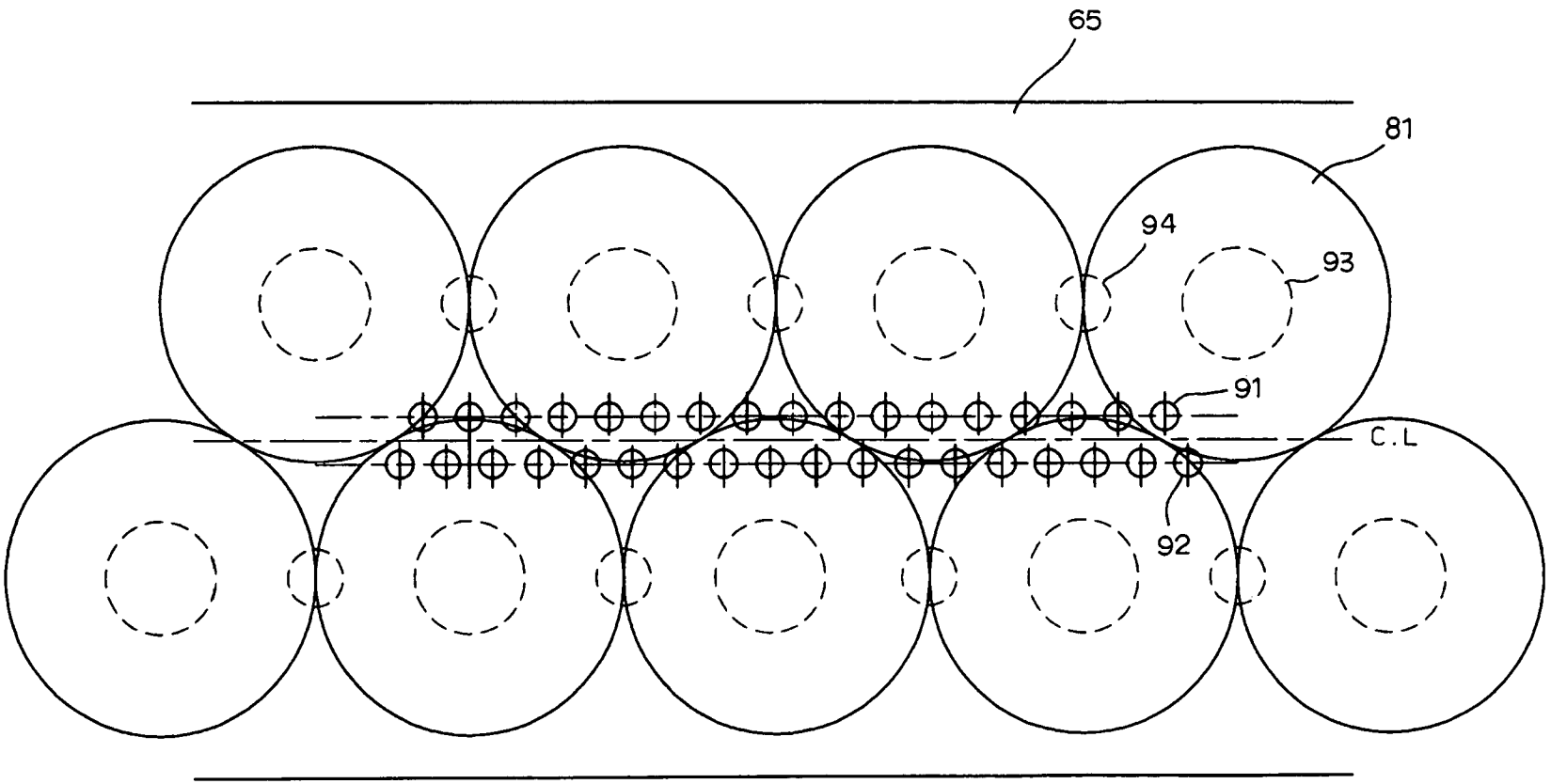
FIG. 7 is a diagram showing a positional relationship between rod lenses in the related-art optical head and light spots formed by the related-art optical head.

As shown in FIG. 5, light emitted from the photo emitter 63 of the photo emitter array 61 transmits the glass substrate 62 to outgo toward the image carrier 20. With the glass substrate 62, a surface formed with the photo emitter 63 and that surface, from which light outgoes, are made substantially in parallel to each other.

Figure 1:
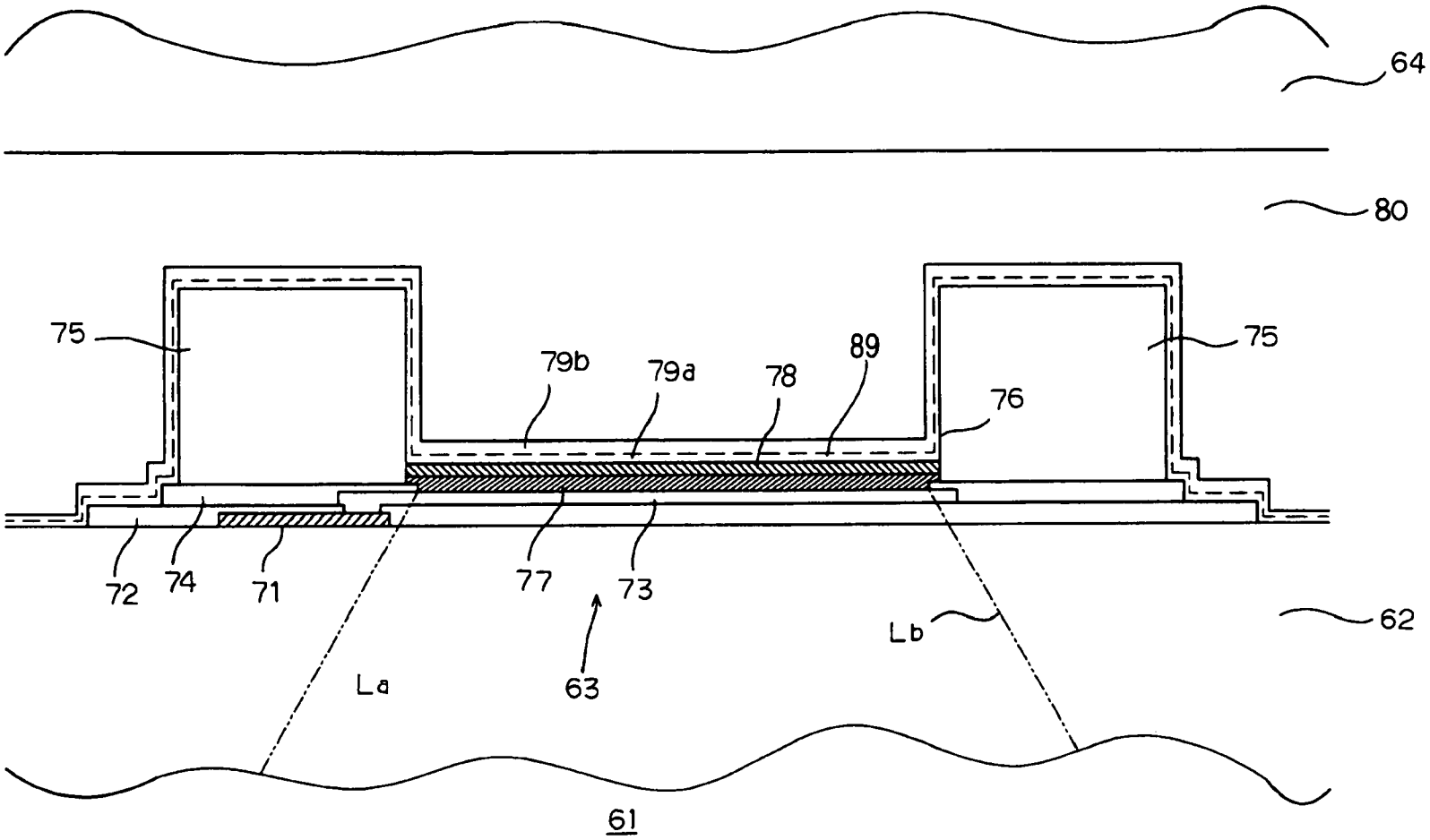
FIG. 1 is a schematic section view of a photo emitter in an optical head according to a first embodiment of the invention.

As shown in FIG. 1, the photo emitter array 61 comprises TFTs (thin film transistors) 71 made of polysilicon having a thickness of 50 nm and provided on the glass substrate 62, which has a thickness of, for example, 0.5 mm, to control light emission of the respective photo emitters 63. As shown in FIG. 4, the TFTs 71 are arranged so as not to intercept light La emitted from each of the photo emitters 63 which are arranged in a zigzag manner so as to form two rows.

An insulating film 72 formed from $SiO_2$ having a thickness in the order of 100 nm is deposited on the glass substrate 62 except contact holes on the TFTs 71, and anodes 73 formed from ITO having a thickness of 150 nm are formed so as to be connected to the TFTs 71 through the contact holes. Subsequently, an insulating film 74 formed from $SiO_2$ having a thickness in the order of 120 nm is deposited on regions corresponding to other positions than the photo emitters 63.

Banks 75 formed from polyimide having a thickness of 2 μm and formed with holes 76, which correspond to the photo emitters 63, are provided on the insulating film 74, and an electron-hole injected layer 77 having a thickness of 50 nm and a light emitting layer 78 having a thickness of 50 nm are deposited, in this order from the anodes 73, in the holes 76 of the banks 75. A first cathode layer 79*a* formed from calcium having a thickness of 100 nm and a second cathode layer 79*b* formed from aluminum having a thickness of 200 nm are deposited in this order in a manner to cover an upper face of the light emitting layer 78, inner surfaces of the holes 76, and outer surfaces of the banks 75.

The photo emitter 63 of the photo emitter array 61 is provided above the layers to be covered by the cover glass 64 having a thickness in the order of 1 mm and inert gas 80 such as nitrogen gas is filled therebetween. Light emission from the photo emitters 63 is performed on a side of the glass substrate 62. Outgoing light La, Lb from the light emitting layer 78 is projected onto the image carrier 20 through the rod lenses 81. Since it is configured that the photo emitters (organic EL elements) 63 are formed on the glass substrate 62, light transmission is made favorable. In addition, the photo emitters 63 can be easily fabricated with an arbitrary shape.

When the photo emitters 63 operate to emit light, stray light is formed due to various factors in addition to the normal outgoing light La, Lb outgoing toward the image carrier 20. As described above, the second cathode layer 79*b* is formed from metal, such as aluminum, having a high reflection coefficient. Therefore, a part of stray light is reflected by the second cathode layer 79*b* to transmit the glass substrate 62 to form ghost light spots on the image carrier through the rod lenses 81.

In this embodiment, the optical head is constructed so that such ghost light spots are not formed on the image carrier. As an example of a concrete construction, measures are taken to decrease the cathode layers in reflection coefficient. Specifically, an anti-reflection layer 89 is formed on a surface of the first cathode layer 79*a* facing the light emitting layer 78 by sticking of an anti-reflection film, for example. With this configuration, the stray light is reflected by the second cathode layer 79*b* having a high reflection coefficient can be reduced, thus preventing that deterioration in image formation quality, which is caused by formation of ghost light spots on the image carrier 20.

The anti-reflection film is fabricated by alternately laminating a metal, a dielectric substance, and a transparent conductive material on a film by sputtering or deposition. Since such an anti-reflection film has used for various applications, it is possible to fabricate it with low cost.

Alternatively, the anti-reflection layer 89 may be formed by coating an anti-reflection coating liquid on the surface of the cathode layer facing the light is emitting layer 78. The anti-reflection coating liquid is coated in the wet process. In this case, reflection of stray light can be prevented by a simple processing. In addition, instead of providing the anti-reflection layer 89, the cathode layer can be decreased in reflection coefficient for stray light by increasing surface roughness of the surface of the second cathode layer 79*b* facing the light emitting layer 78. In this case, since any further member is not provided, cost reduction can be attained.

Next, a second embodiment of the invention will be described. Components similar to those in the first embodiment will be designated by the same reference numerals and repetitive explanations for those will be omitted.

Figure 8:
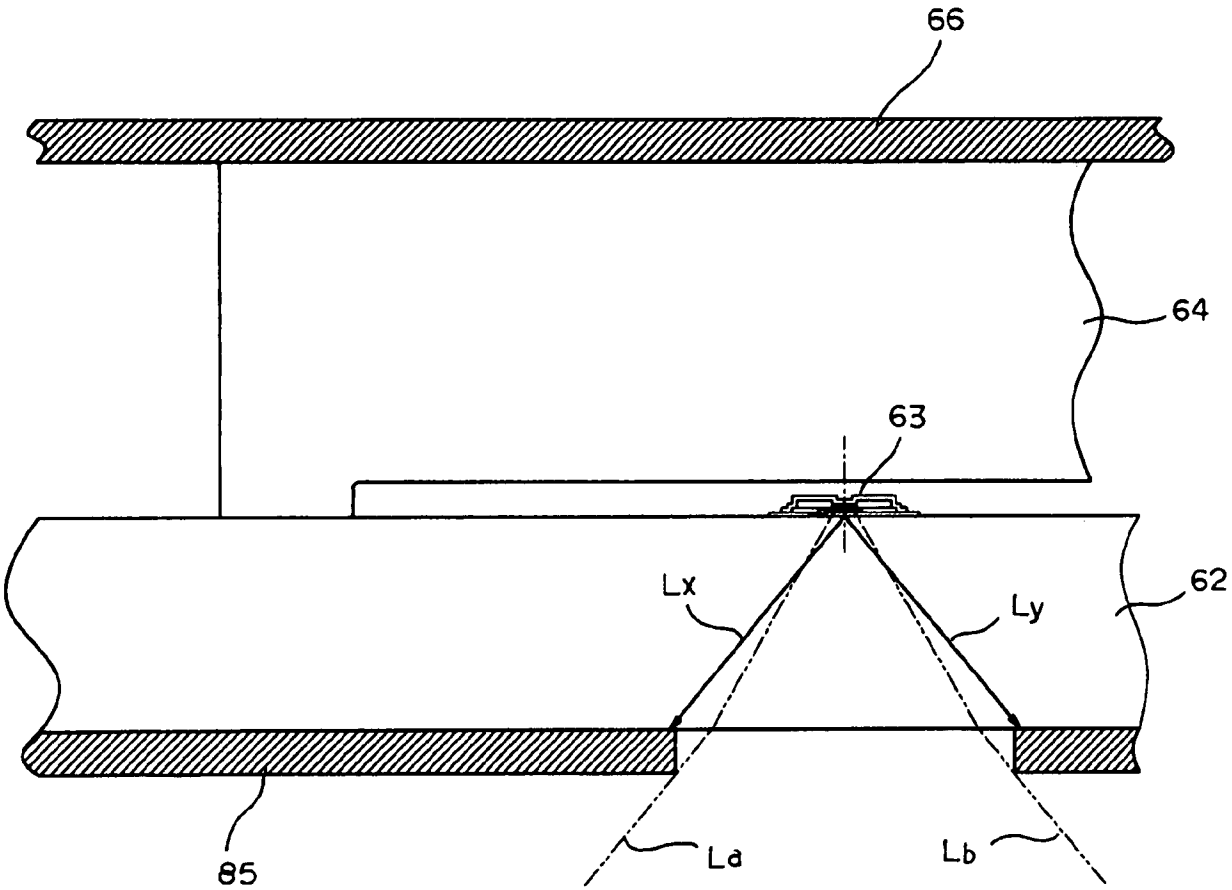
FIG. 8 is a schematic section view of a photo emitter in an optical head according to a second embodiment of the invention.

In this embodiment, as shown in FIG. 8, a cover layer 85 is formed on a surface of the glass substrate 62 facing the image carrier 20. The cover layer 85 is provided as a light absorbing member coated with, for example, a black paint.

The cover layer 85 is formed outside an effective light projecting region which is defined between dashed chain lines La and Lb in FIG. 8 Therefore, the cover layer 85 does not make an obstacle to projection of light emitted from the photo emitters 63 onto an image forming region of the image carrier 20, a decrease in efficiency of projection is not incurred. By providing the cover layer 85, it is possible to absorb stray light Lx, Ly reflected by the second cathode layer 79*b*. Accordingly, it is possible to prevent ghost light spots from being formed on the image carrier 20 by stray light Lx, Ly. Since the light absorbing member can be formed by coating of a black paint, the construction can be made inexpensive.

Next, a third embodiment of the invention will be described. Components similar to those in the second embodiment will be designated by the same reference numerals and repetitive explanations for those will be omitted.

Figure 9:
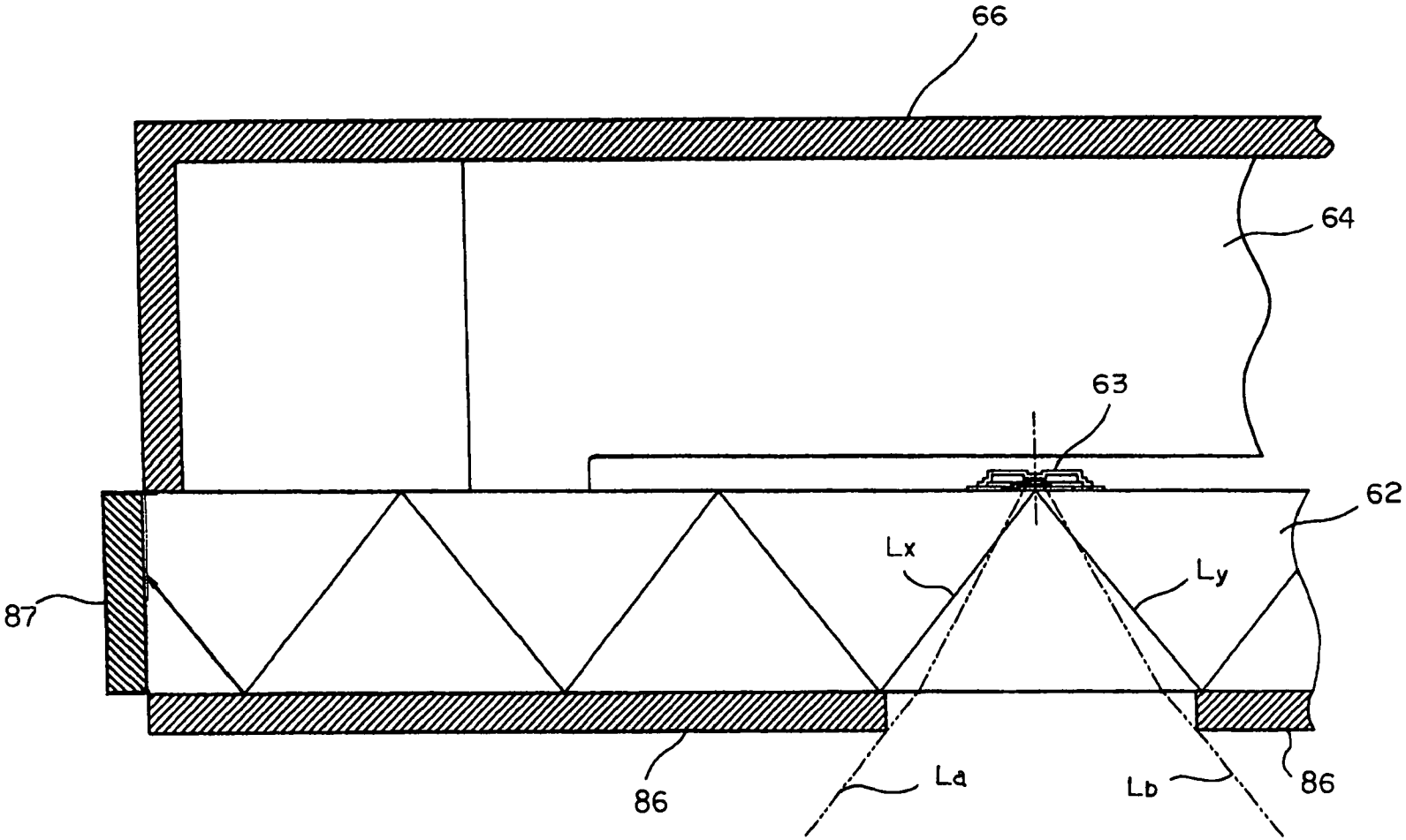
FIG. 9 is a schematic section view of a photo emitter in an optical head according to a third embodiment of the invention.

In this embodiment, as shown in FIG. 9, a cover layer 86 is formed by a reflection mirror, that is, a light reflecting member. The cover layer 86 is also formed outside the effective light projecting region with respect to the image carrier 20 as well as the second embodiment. Further, light absorbing members 87 are provided on ends of the glass substrate 82. The light absorbing members 87 can be structured to be coated with a black paint.

With the above configuration, stray light Lx and Ly reflected by the cover layer 86 to propagate in the glass substrate 62 to reach the ends thereof. Here, the light is absorbed by the light absorbing members 87 to be prevented from being projected onto the image forming region of the image carrier 20.

Next, a fourth embodiment of the invention will be described. Components similar to those in the third embodiment will be designated by the same reference numerals and repetitive explanations for those will be omitted.

Figure 10:
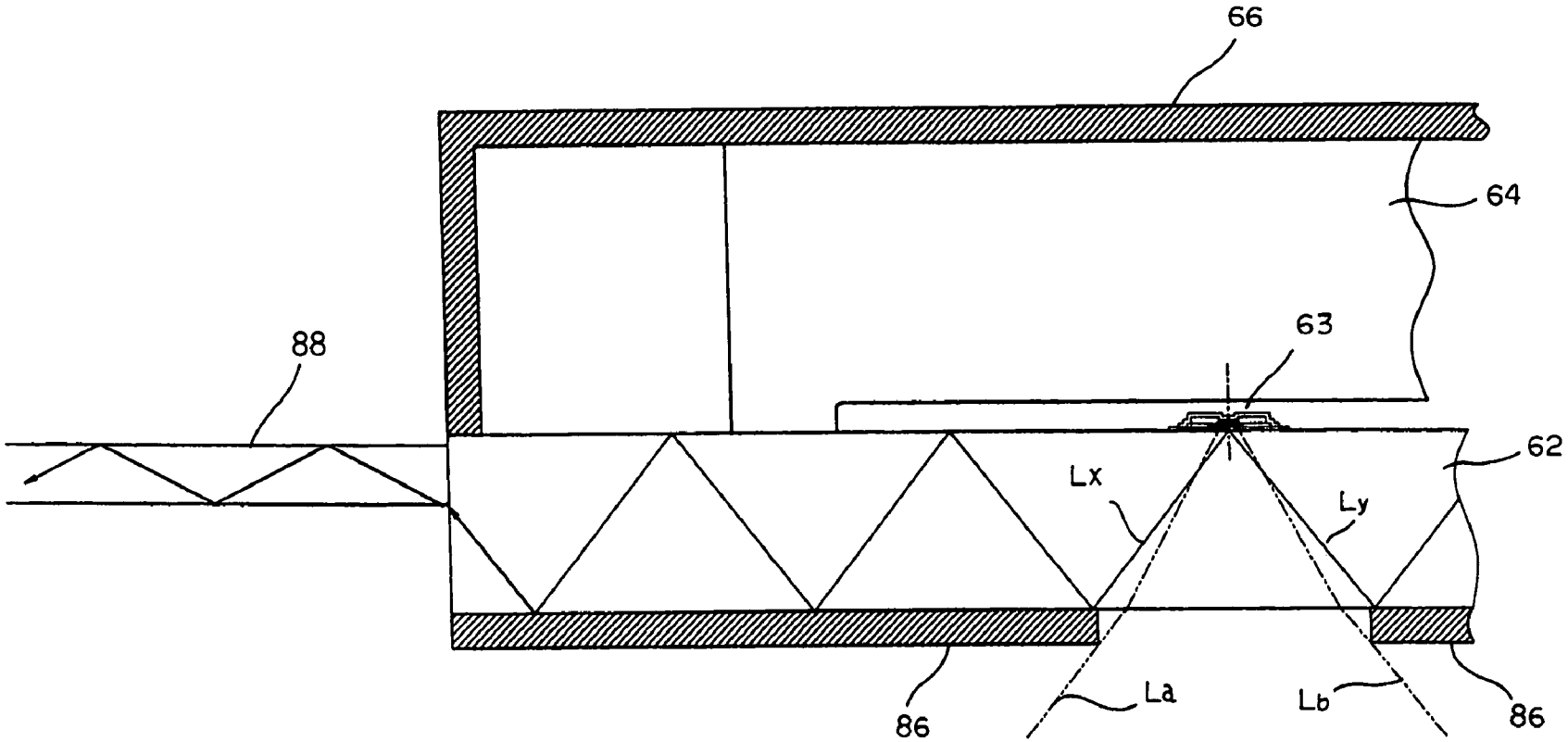
FIG. 10 is a schematic section view of a photo emitter in an optical head according to a fourth embodiment of the invention.

In this embodiment, as shown in FIG. 10, light leading members 88 are provided on ends of the glass substrate 62 so that stray light Lx propagating in the glass substrate 62 to reach the ends thereof is made incident upon the light leading members 88. Stray light Lx is irradiated outside the image forming region from the light leading members 88. Likewise, stray light Ly transmits the light leading members 88 formed on the ends of the glass substrate 62 to be irradiated outside the image forming region.

Next, a fifth embodiment of the invention will be described. Components similar to those in the second embodiment will be designated by the same reference numerals and repetitive explanations for those will be omitted.

Figure 11:
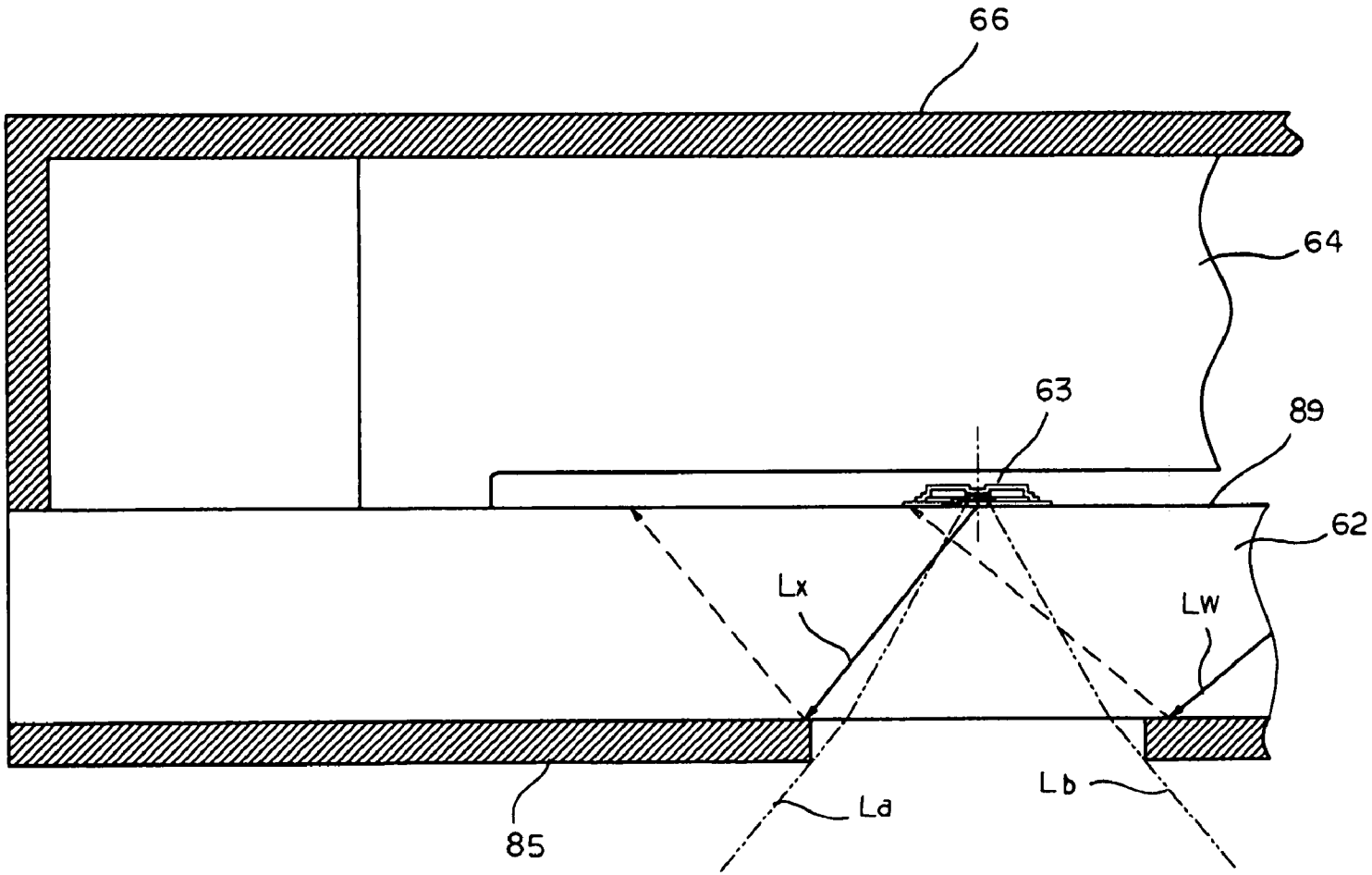
FIG. 11 is a schematic section view of a photo emitter in an optical head according to a fifth embodiment of the invention.

In this embodiment, as shown in FIG. 11, an anti-reflection layer 89 is formed on a surface of the glass substrate 62 facing the light emitters 63 in addition to the cover layer 85 as described in the second embodiment. The anti-reflection layer 89 is formed by sticking of an anti-reflection film. Stray light Lx having not been absorbed by the cover layer 85 propagates in the glass substrate 62 as indicated by dashed lines, but the stray light Lx is prevented from being again reflected to propagate in the glass substrate 62 by the anti-reflection layer 89. Lw denotes stray light produced by a photo emitter adjacent to the photo emitter 63.

The formation of the anti-reflection layer 89 may be applicable with respect to the configurations of the third and fourth embodiments. By providing a plurality of measures for preventing stray light from being projected onto the image carrier 20, it is possible to effectively improve the image formation quality.

Next, a sixth embodiment of the invention will be described. Components similar to those in the first embodiment will be designated by the same reference numerals and repetitive explanations for those will be omitted.

Figure 12:
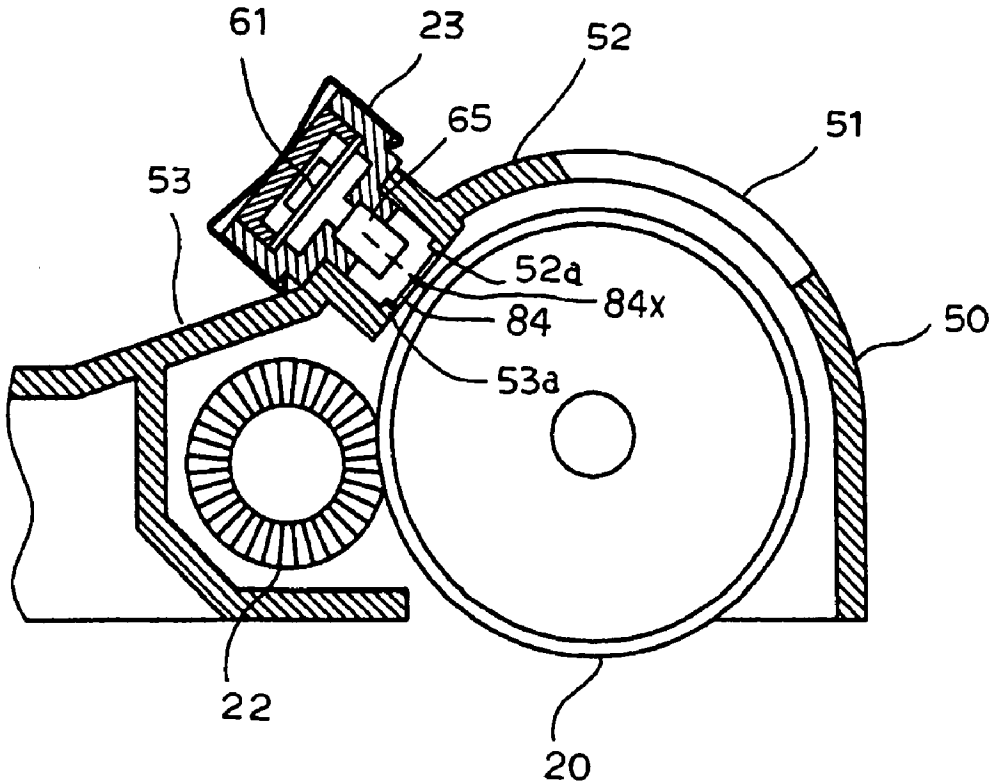
FIG. 12 is a section view of a part of an image forming unit including an optical head according to a sixth embodiment of the invention.

In this embodiment, as shown in FIG. 12, a flange 52*a* is provided on one end of the shielding portion 52 to extend toward the rod lens array 65. Also, a flange 53*a* is provided on one end of the shielding portion 53 to extend toward the rod lens array 65. A shielding plate 84 is provided between the flange 52*a* and the flange 53*a*. The shielding plate 84 is formed with a light leading slit 84*x*. The light leading slit 84*x* is formed to be sized so as to permit only light emitted from the photo emitter 63 to be projected onto the image carrier 20. That is, light emitted from the photo emitter 63 transmits the respective rod lenses 81 of the rod lens array 65 to be projected onto the image carrier 20. Stray light is shielded by the shielding plate 84 not to be projected onto the image carrier 20. In addition, instead of providing the shielding plate 84, a cover made integral with the shielding portions 52, 53 may be provided and the light leading slit 84*x* may be formed on the cover.

With this configuration, it is possible to shield stray light reflected by the second cathode layer 79*b*. Accordingly, it is possible to prevent ghost light spots from being formed on the image carrier 20 by the stray light. That is, it is possible to prevent generation of image unevenness to improve the image formation quality.

Next, a seventh embodiment of the invention will be described. Components similar to those in the sixth embodiment will be designated by the same reference numerals and repetitive explanations for those will be omitted.

Figure 13:
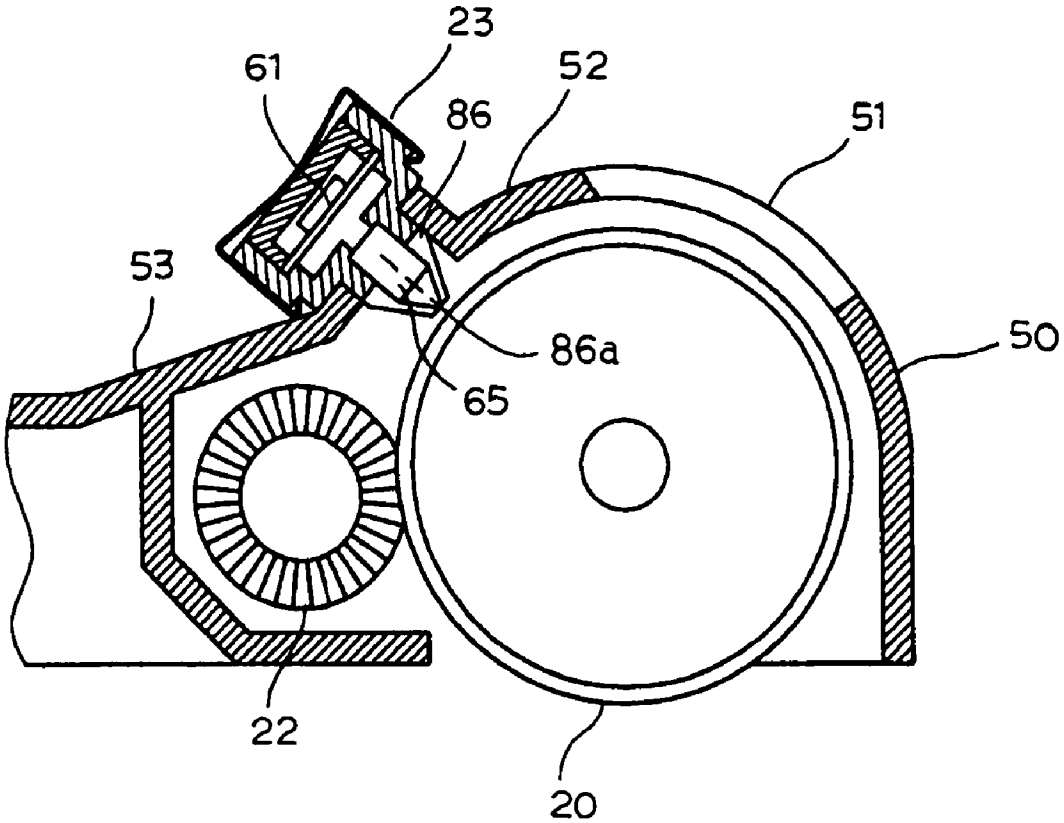
FIG. 13 is a section view of a part of an image forming unit including an optical head according to a seventh embodiment of the invention.

In this embodiment, as shown in FIG. 13, a light leading cover 86 covers a periphery of a rod lens array 65. The light leading cover 86 is in the form of a substantially frustum to be formed at an apex portion thereof with an opening 86*a*. Light emitted from photo emitters 63 to transmit the respective rod lenses 81 of the rod lens array 65 is projected onto the image carrier 20 from the opening 86*a*. With this configuration, it is possible to prevent ghost light spots from being formed on the image carrier 20 by the stray light.

Figure 14:
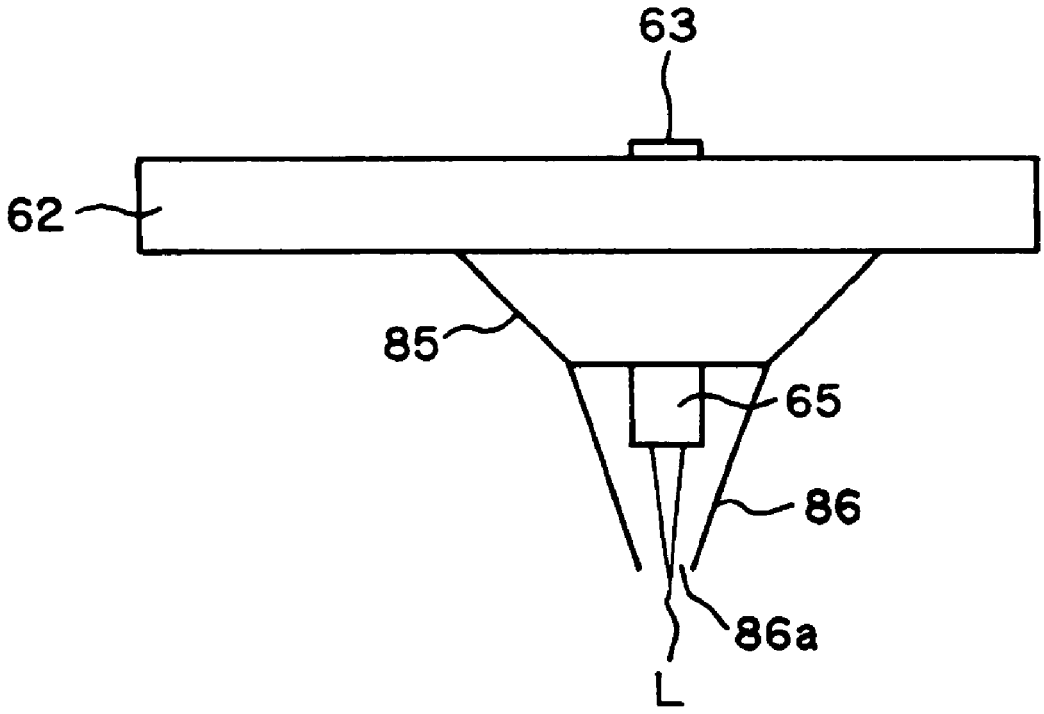
FIG. 14 is a side view of a part of the optical head of FIG. 13.

As shown in FIG. 14, the photo emitters 63 are formed on one surface of the glass substrate 62, and a support base 85 is provided on another surface of the glass substrate 62 facing the image carrier 20. The rod lens array 65 is mounted on the support base 85.

The light leading cover 86 serves to prevent ghost light spots from being formed on the image carrier 20 by stray light, and can be used as a member for positioning the rod lens array 65 relative to the image carrier 20. Therefore, it is possible to prevent positional deviation of the rod lenses 81. Also, it is possible to prevent scattered toner from adhering to the rod lenses 81 to achieve prevention of contamination of the rod lenses 81.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image forming apparatus, comprising:

an image carrier on which an electrostatic latent image is formed; and an optical head for forming the electrostatic latent image on the image carrier, comprising:

a lens, having an outgoing surface opposing the image carrier and an incoming surface opposite the outgoing surface;

a transparent substrate, having a first surface opposing the image carrier and a second surface opposite the first surface;

an organic EL photo emitter, disposed on the second surface of the substrate and comprising:

a light emitting layer, for emitting light toward the incoming surface of the lens, the light passing through the lens and being output from the outgoing surface so as to irradiate the image carrier to form the electrostatic latent image; and an electrode layer, laminated on the light emitting layer; and a cover member, disposed between the outgoing surface of the lens and the image carrier, the cover member being formed with an aperture for allowing only the light output from the photo emitter to the outgoing surface of the lens to pass therethrough.

2. The image forming apparatus as set forth in claim 1, wherein the cover member is shaped into a frustum, and the aperture is formed at an apex portion thereof.

3. An image forming apparatus, comprising:

an image carrier on which an electrostatic latent image is formed; and an optical head for forming the electrostatic latent image on an image forming region of the image carrier, and comprising:

a transparent substrate, having a first surface opposing the image carrier and a second surface opposite the first surface;

an organic EL photo emitter, disposed on the second surface of the substrate and comprising:

a light emitting layer, for emitting light toward the image carrier to form the electrostatic latent image; and an electrode layer, laminated on the light emitting layer; and a reflection reducer, coating the first surface of the substrate except a region that is necessary to project the light onto the image forming region of the image carrier so as to prevent reflected light from outputting from the first surface of the substrate, the reflected light being generated when the light emitted from the light emitting layer is reflected by at least the electrode layer.

4. The image forming apparatus as set forth in claim 3, wherein the reflection reducer includes:

a light reflecting layer, provided on the first surface of the substrate; and a light absorbing layer, provided on end faces of the substrate connecting the first surface and the second surface.

5. The image forming apparatus as set forth in claim 3, wherein the reflection reducer includes:

a light reflecting layer, provided on the first surface of the substrate; and a light leading member, provided on end faces of the substrate connecting the first surface and the second surface, and leading light reflected by the light reflecting layer toward an area on the image carrier to be irradiated with the light emitted from the photo emitter.

6. The image forming apparatus as set forth in claim 3, wherein the reflection reducer includes an anti-reflection film disposed on the second surface of the substrate.

7. The image forming apparatus as set forth in claim 3, wherein the reflection reducer includes an anti-reflection coating provided on the second surface of the substrate.

8. The image forming apparatus as set forth in claim 3, wherein the reflection reducer includes the second surface of the substrate a surface roughness of which is made greater than a surface roughness of the first surface of the substrate.

9. The image forming apparatus as set forth in claim 3, wherein the substrate is comprised of glass.

10. The image forming apparatus as set forth in claim 3, wherein the reflection reducer includes a light absorbing layer provided on the first surface of the substrate.

* * * * *